US007068129B2

(12) United States Patent
Higgins et al.

(10) Patent No.: US 7,068,129 B2
(45) Date of Patent: Jun. 27, 2006

(54) TUNABLE WAVEGUIDE FILTER

(75) Inventors: John A. Higgins, Westlake Village, CA (US); Hao Xin, Tucson, AZ (US)

(73) Assignee: Rockwell Scientific Licensing, LLC, Thousand Oaks, CA (US)

( * ) Notice: Subject to any disclaimer, the term of this patent is extended or adjusted under 35 U.S.C. 154(b) by 4 days.

(21) Appl. No.: 10/864,786

(22) Filed: Jun. 8, 2004

(65) Prior Publication Data

US 2005/0270125 A1 Dec. 8, 2005

(51) Int. Cl.
*H01P 1/207* (2006.01)

(52) U.S. Cl. ..... 333/209; 333/208

(58) Field of Classification Search ..... 333/208, 333/209, 134, 135
See application file for complete search history.

(56) References Cited

U.S. PATENT DOCUMENTS 3,657,670 A * 4/1972 Kitazume et al. ..... 333/209
4,030,051 A 6/1977 Shimizu et al.
4,124,830 A 11/1978 Ren
5,691,677 A 11/1997 DeMaron et al.
5,892,414 A 4/1999 Doughty et al.
5,935,910 A * 8/1999 Das ..... 505/210
5,959,512 A * 9/1999 Sherman ..... 333/209
6,628,242 B1 * 9/2003 Hacker et al. ..... 343/909

OTHER PUBLICATIONS

Higgins et al., "Tunable Millimeter Wave Band-Pass Filter Using Electromagnetic Crystal Sidewalls", Microwave symposium Digest, 2004, IEEE MTT-S International, vol. 3, Jun. 6-11, 2004, pp. 1295-1298.*

* cited by examiner

*Primary Examiner*—Seungsook Ham
(74) *Attorney, Agent, or Firm*—Koppel, Patrick & Heybl

(57) ABSTRACT

A tunable filter includes a waveguide with at least one resonant cavity and a tunable impedance structure coupled to each resonant cavity. Each resonant cavity has a resonant frequency and its corresponding impedance structure can be tuned to adjust the resonant frequency. The filter transmits the signal in a pass-band that includes the resonant frequency and reflects signals outside the pass-band.

28 Claims, 7 Drawing Sheets

FIG. 2
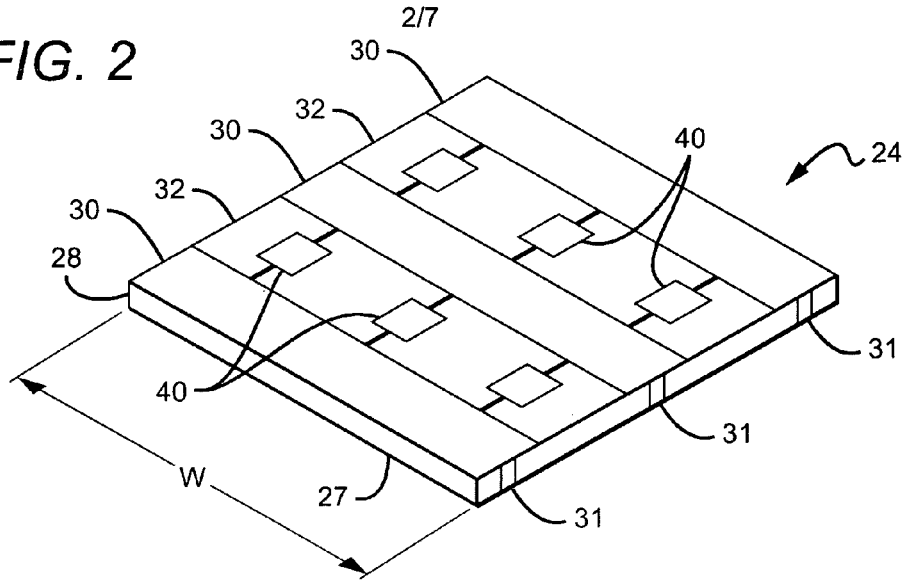
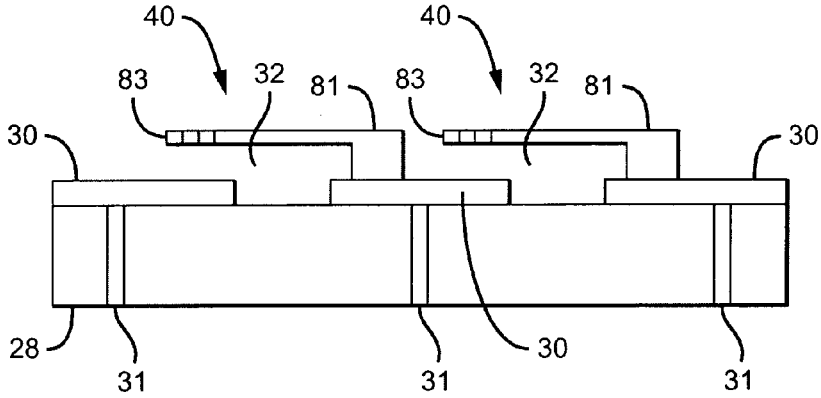
FIG. 3a
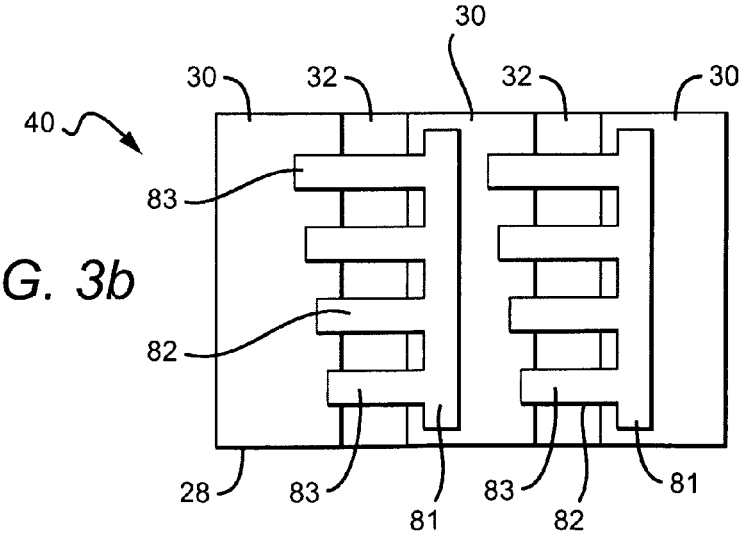
FIG. 3b

FIG. 4
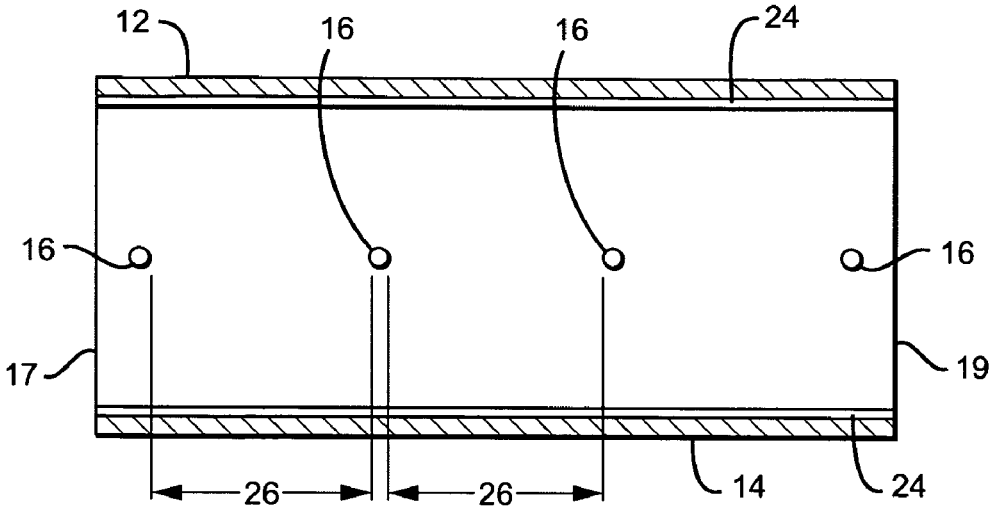
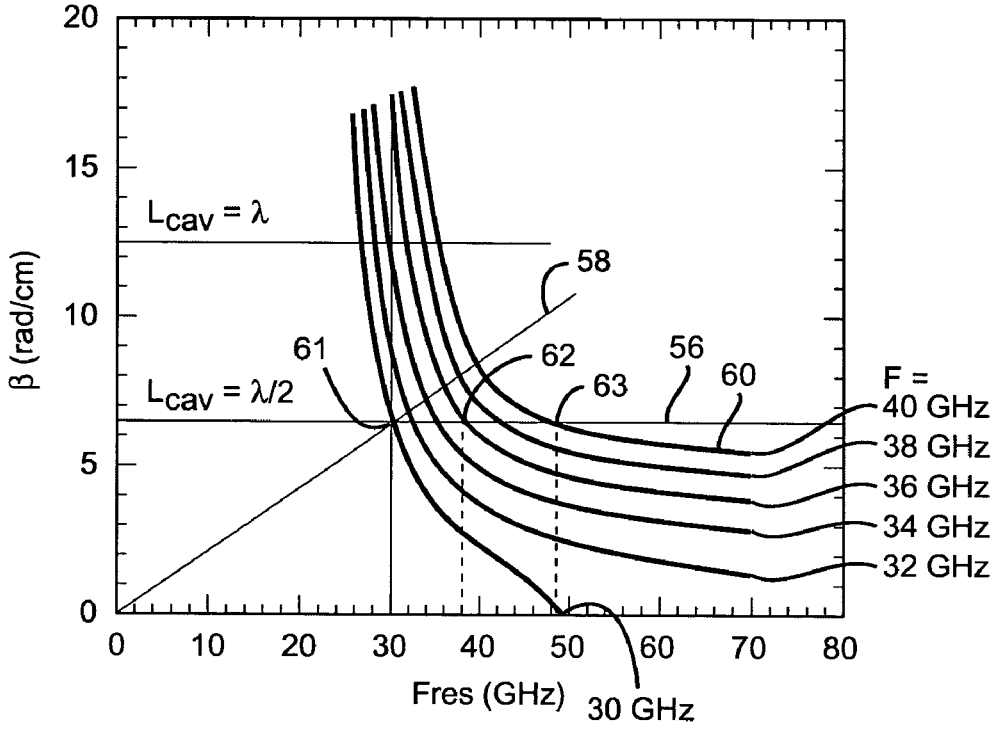
FIG. 5

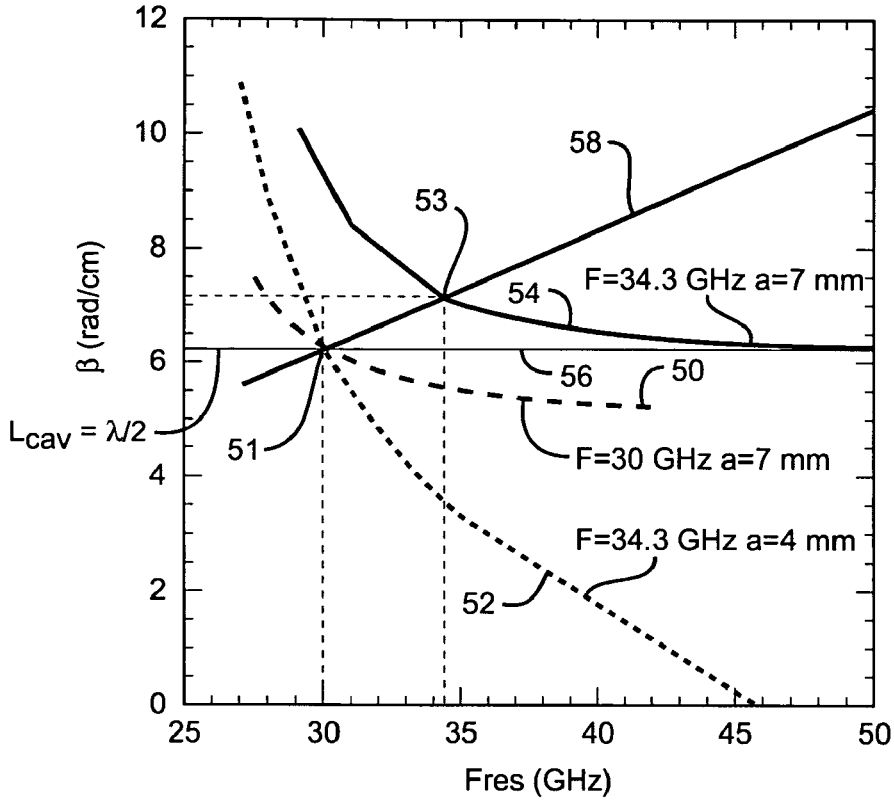
FIG. 6
FIG. 7
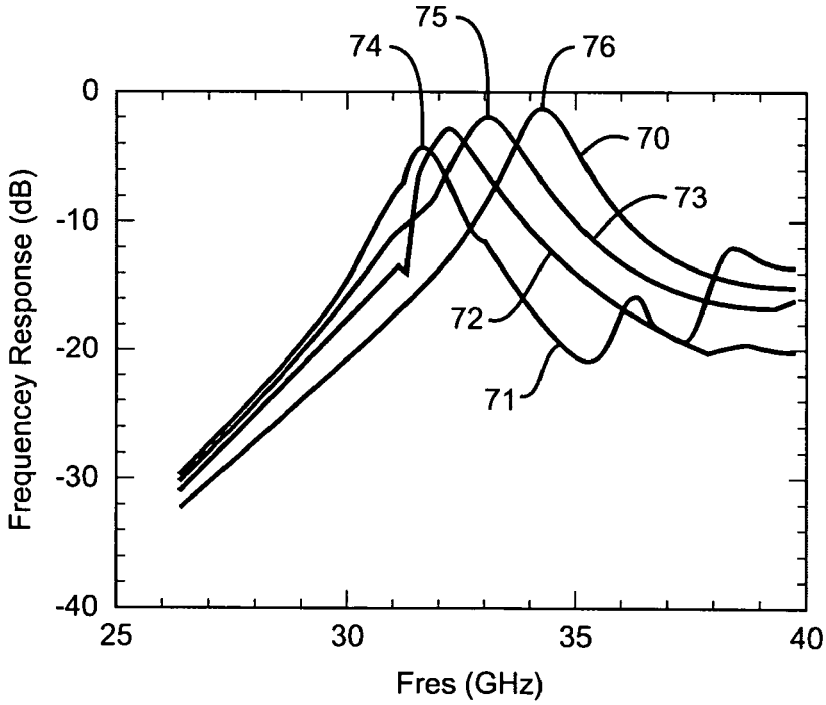

FIG. 8a
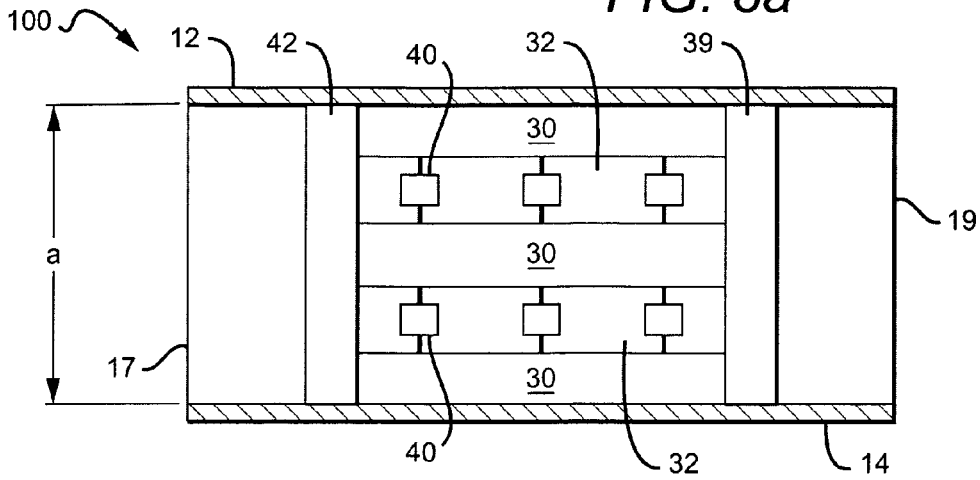
FIG. 8b
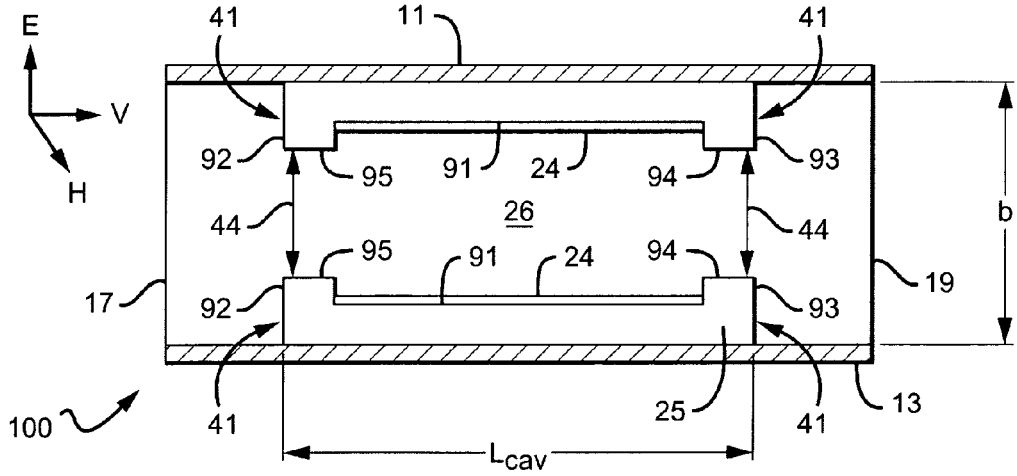
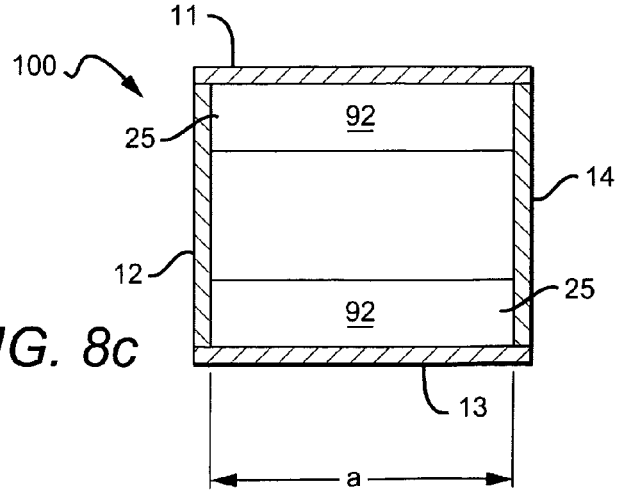
FIG. 8c

TUNABLE WAVEGUIDE FILTER

BACKGROUND OF THE INVENTION

1. Field of the Invention

This invention relates generally to waveguides and, more particularly, to tunable waveguide filters.

2. Description of the Related Art

Electromagnetic signals with wavelengths in the millimeter range are typically guided to a destination by a waveguide because of insertion loss considerations. An example of one such waveguide can be found in U.S. Pat. Nos. 6,603,357 and 6,628,242 which disclose waveguides with electromagnetic crystal (EMXT) surfaces. The EMXT surfaces allow for the transmission of high frequency signals with near uniform power density across the waveguide cross-section. More information on EMXT surfaces can be found in U.S. Pat. Nos. 6,262,495 and 6,483,480.

In some waveguide systems, filters are used to control the flow of signals during transmission and reception. The filters are chosen to provide low insertion loss in the selected bands and high power transmission with little or no distortion. A typical millimeter wave system includes separate waveguide and filter combinations, with each combination being sensitive to a different resonant frequency. The filters include a resonant cavity that can be tuned to a particular resonant frequency using mechanical adjustments such as tuning screws as disclosed in U.S. Pat. No. 5,691,677 or movable dielectric inserts as disclosed in U.S. Pat. Nos. 4,459,564 and 6,392,508. In both of these cases, tuning is accomplished by mechanically adjusting the screw or insert to change the length of the resonant cavity and the resonant frequency.

If the mechanical adjustment cannot tune the resonant frequency quickly enough, then more waveguide and filter combinations will be needed, with each one tuned for a different resonant frequency. For example, a single antenna can be coupled to separate filters and their corresponding waveguides. In this setup, one filter-waveguide combination can be tuned to transmit and receive communication signals in one frequency band and another can be tuned to transmit and receive radar signals in a different frequency band. It is desired, however, to reduce the number of waveguide-filter combinations needed to transmit signals over the different frequency bands.

SUMMARY OF THE INVENTION

The present invention provides a tunable filter which includes a waveguide with one or more resonant cavities. Each resonant cavity has a resonant frequency that is tunable in response to tunable impedance structures coupled to each of the resonant cavities. The filter transmits the signal in a pass-band which includes the resonant frequency and reflects the signal outside the pass-band. The tuning can be done by adjusting the impedance and/or resonant frequency of the impedance structures to change a propagation constant of the signal and provide the filter with a desired frequency response.

The tunable filter can be used in a communication system which includes multiple communication platforms. The waveguide filter can be connected to the communication platforms to provide frequency selective communications between them and an external system, such as an antenna.

These and other features, aspects, and advantages of the present invention will become better understood with reference to the following drawings, description, and claims.

BRIEF DESCRIPTION OF THE DRAWINGS

FIG. 2 is a simplified perspective view of a tunable impedance structure with variable capacitance devices;

FIGS. 3*a* and 3*b* are simplified top and side views, respectively, of tunable impedance structures which include micro-electromechanical devices with variable capacitances;

FIG. 4 is a simplified top elevation view of another embodiment of a tunable waveguide filter;

FIG. 5 is a graph of the propagation constant of a signal traveling through the waveguide filter shown in FIG. 1 verses the resonant frequency;

FIG. 6 is a graph of the propagation constant of a signal traveling through the waveguide filter of FIG. 1 verses the resonant frequency;

FIG. 7 is a graph of the frequency response of the waveguide filter shown in FIG. 1 verses the operating frequency;

FIGS. 8*a*, 8*b*, and 8*c* are simplified top, side, and front elevation views, respectively, of a tunable waveguide filter;

DETAILED DESCRIPTION OF THE INVENTION

Figure 1A:
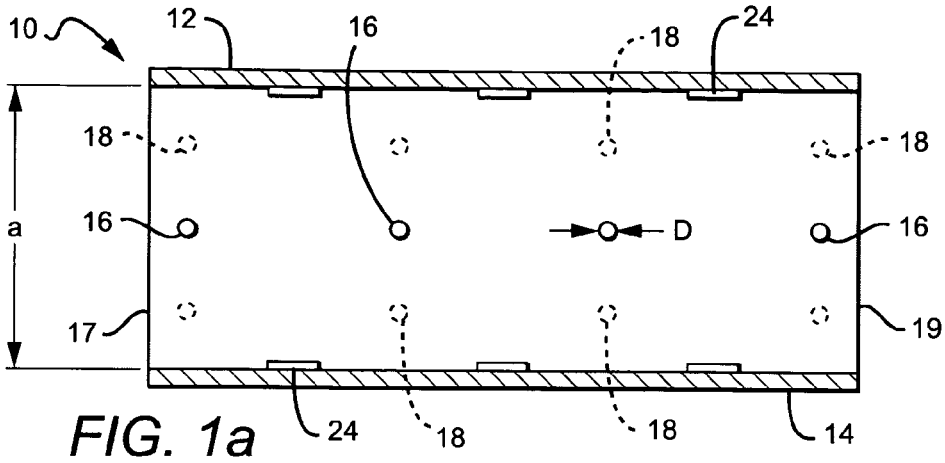
FIGS. 1*a*, 1*b*, and 1*c* are simplified top, side, and front elevation views, respectively, of a tunable waveguide filter.
Figure 1B:
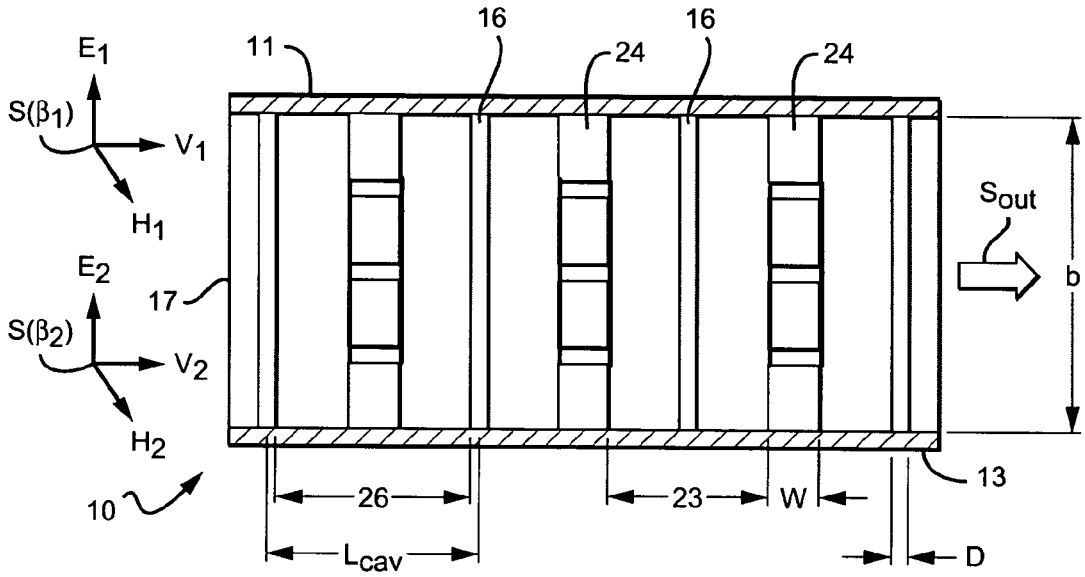
Figure 1C:
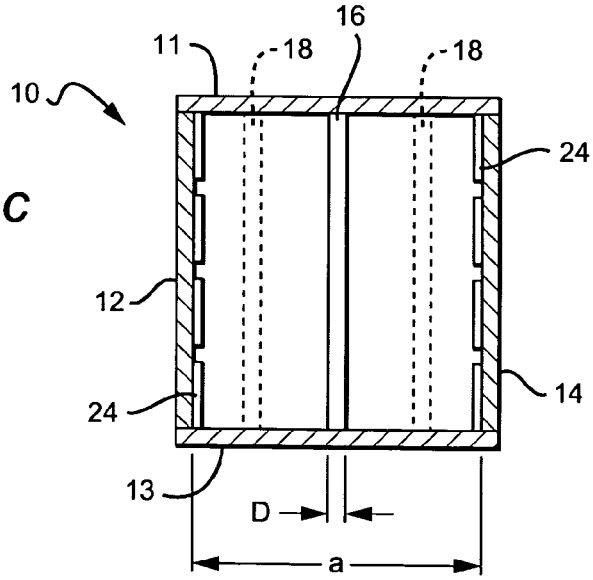

FIGS. 1*a*, 1*b*, and 1*c* show top, side, and front elevation views, respectively, of a waveguide filter 10 which includes tunable impedance structures 24 on opposed sidewalls 12 and 14. The other waveguide sidewalls 11 and 13 are spaced apart by a height b (See FIG. 1*b*) and sidewalls 12 and 14 are spaced apart by a width a (See FIG. 1*c*) so that filter 10 has a rectangular cross-section. The cross-sectional shape of filter 10 typically depends on the polarization of the signal propagated through the filter, so it can have a cross-section other than rectangular. For example, the cross-section can be circular for a coaxial waveguide structure which guides circularly polarized signals. The impedance structures in this case can be positioned 180° from one another.

Cavity forming boundary structures 16, which are conductive posts with diameters D, are positioned within the waveguide and are electrically spaced apart by a distance $L_{cav}$ to form cavities 26. Structures 16 extend vertically between sidewalls 11 and 13 and the spacing of structures 16 extends longitudinally along filter 10 between ends 17 and 19. $L_{cav}$ refers to the electrical length of each resonant cavity 26. This is equal to the physical length of the cavity multiplied by the ratio of the propagation time of a signal through the cavity to the propagation time of a signal in free space over a distance equal to the physical length of the cavity.

The number and arrangement of structures 16 can be chosen to provide filter 10 with a desired quality factor Q. For example, optional cavity forming boundary structures 18 can be positioned adjacent to structures 16 and between sidewalls 12 and 14 so that multiple conductive posts define each end of resonant cavity 26. This has the effect of changing the total inductance and Q of cavity 26 because the posts are electrically connected in parallel.

Impedance structures 24, each with a width w, are spaced apart by a distance 23 so that there is one pair on opposed sidewalls 12 and 14 within each cavity 26. Structures 24 include electromagnetic crystals (EMXT) surfaces which can be used to obtain a desired surface impedance in a band of frequencies around the resonant frequency, $F_{res}$, of structure 24 with one such band being the Ka-Band.

Cavities 26 are one half of a wavelength long at the cavity resonant frequency $F_{cav}$, so the surface impedance of structure 24 can be changed to tune $F_{res}$ relative to $F_{cav}$. This has the effect of allowing some signals with a desired propagation constant β and operating frequency F to be outputted through end 19 as signal $S_{out}$, while reflecting signals with different β values and frequencies. For example, $S_{out}$ will equal $S(\beta_1)$ or $S(\beta_2)$ if the impedance of structures 24 is chosen so that $F_{res}$ resonates with signals $S(\beta_1)$ or $S(\beta_2)$, respectively. Because the impedance of structure 24 determines which β values will resonate with $F_{cav}$, filter 10 can selectively transmit some frequencies in a pass-band while reflecting others outside the pass-band. The signals are represented by an electromagnetic wave with an electric field E, a magnetic field H, and a velocity U (See FIG. 1*b*). β is related to the waveguide wavelength $\lambda_g$ through the well-known equation $\beta=2\pi/\lambda_g$. Wavelength $\lambda_g$ is related to F by the equation $\lambda_g=\lambda_o/\sqrt{(1-(\lambda_o/2a)^2}$ in which $\lambda_o=c/F$ where $\lambda_o$ is the free space wavelength and c is the speed of light.

FIG. 2 shows a more detailed view of impedance structures 24 which include a dielectric substrate 28 with conductive strips 30 which extend parallel to the waveguide's longitudinal axis and face its interior. A conductive sheet 27, which is used as a ground plane, is positioned over the exterior of dielectric substrate 28 and can form a portion of sidewalls 12 and 14. Adjacent conductive strips 30 are spaced apart by gaps 32 and variable capacitance devices 40 are coupled between them to allow their capacitance to be varied to tune $F_{res}$ and, consequently, $F_{cav}$.

Conductive vias 31 extend from strips 30, through substrate 28 to conductive layer 27. Vias 31 and gaps 32 reduce substrate wave modes and surface current flow, respectively, through substrate 28 and between adjacent strips 30. The width of strips 30 present an inductive reactance L to the transverse E field and gaps 32 present an approximately equal capacitive reactance C. Although structures 24 are shown in FIG. 2 as having width W, they can extend down the lengths of sidewalls 12 and 14 as shown in FIG. 4.

Numerous materials can be used to construct impedance structure 24. Dielectric substrate 28 can be made of many dielectric materials including plastics, insulators, poly-vinyl carbonate (PVC), ceramics, or semiconductor material such as indium phosphide (InP) or gallium arsenide (GaAs) Highly conductive material, such as gold (Au), silver (Ag), or platinum (Pt), can be used for conductive strips 30, conductive layer 27, and vias 31 to reduce any series resistance.

With impedance structures 24 on sidewalls 12 and 14, waveguide 10 is particularly applicable to passing vertically polarized signals that have an E field transverse to strips 30. At a particular resonant frequency, strips 30 present an inductive reactance L to the transverse E field, and gaps 32 between strips 30 present an approximately equal capacitive reactance. Hence, structure 24 presents parallel resonant L-C circuits to the signal's transverse E field component (i.e. a high impedance). By controlling and varying the impedance of structures 24 with a bias across capacitors 40, β can be varied and $L_{cav}$ can be changed.

Structures 24 provide a high surface impedance at $F_{res}$ and over a band of frequencies around $F_{res}$. Hence, an incident wave at $F_{res}$ will have a reflection coefficient of one and a phase of zero degrees. For a passive EMXT, without a tuning mechanism such as capacitors 40, the thickness of substrate 28, the area of strips 30, the permittivity ϵ and permeability μ=0 of substrate 28, and the width of gap 32 determine $F_{res}$ and the bandwidth of the pass-band. With capacitors 40, however, $F_{res}$ and β can be varied with a bias voltage by changing the impedance of structures 24. At $F_{res}$, structure 24 is in its highest impedance state so that little or no surface currents can flow normal to strips 30 and, consequently, tangential H fields along strips 30 are zero and the E field is uniform across width a. At frequencies below or above $F_{res}$, structures 24 behave as a non-zero inductive or capacitive surface impedance, respectively.

The capacitance of each capacitor 40 is inversely proportional to the bias across it. Since capacitors 40 between adjacent conductive strips 30 are in parallel, if the reverse bias applied across capacitors 40 increases, then the total capacitance decreases. In this case, structure 24 resonates at a higher frequency. If the reverse bias across capacitors 40 decreases, then the total capacitance increases. In this case, structure 24 resonates at a lower frequency.

Variable capacitors 40 can include varactors, MOSFETS, or micro-electromechanical (MEMS) devices, among other devices with variable capacitances. The varactors can include InP heterobarrier varactors or another type of varactor embedded in impedance structure 24 so that its resonant frequency is electronically tunable. A MOSFET can also be used as an alternative by connecting its source and drain together so that it behaves as a two terminal device. In any of these examples, the capacitance of capacitors 40 can be controlled by devices and/or circuitry embedded in waveguide 10 or positioned externally.

FIGS. 3*a* and 3*b* are simplified side and top views, respectively, of impedance structure 24 with variable capacitors 40 which include micro-electromechanical (MEMS) devices 81. Devices 81 can include magnetic materials, such as nickel (Ni), iron (Fe), and cobalt (Co). The magnetic properties of devices 81 are chosen so that the distance between an end 83 and strip 30 can be changed by applying a magnetic field. Each device has multiple fingers 82 extending between adjacent strips 30. The magnetic field then controls the capacitance between adjacent conductive strips 30. As the distance between them decreases, the capacitance increases. Also, the number of fingers 82 that bend increases as the magnitude of the magnetic field increases, so that the capacitance of devices 81 is more linear as a function of magnetic field. The capacitance also increases as the overlap between end 83 and conductive strip 30 increases. These relationships are given by the well-known equation $C=\epsilon A/d$, in which ϵ is the permittivity, A is the overlap area, and d is the distance, all between end 83 and strip 30.

FIG. 5 is a graph of the propagation constant β (rad/cm) of a signal that will resonate with $F_{cav}$ verses $F_{res}$ (GHz). In this graph, a range of operating frequencies F between 28 GHz to 40 GHz is plotted where width a is equal to 4 mm. The center of the pass-band is tuned from 31.6 GHz to 33.2 GHz by varying the bias of variable capacitors 40 from 0 V to 10 V. Curve 56 is the β value in the absence of impedance structures 24 (i.e. sidewalls 11–14 are all conductive). Curve 58 is the β value for free space, which corresponds to the signal propagating outside waveguide 10.

For resonance to occur, $L_{cav}$ should be one-half of the signal wavelength which, in this case, is equal to 5 mm so that a signal with β=6.28 rad/cm will resonate with $F_{cav}$. If it is desired to have signals at F=30 GHz, 36 GHz, or 40 GHz resonate with cavity 26, then $F_{res}$ should be equal to about 30 GHz (point 61), 34 GHz (point 62), or 49 GHz (point 63), respectively. Hence, filter 10 is tuned by changing the impedance of structures 24 which changes $F_{res}$.

FIG. 6 is another graph of the propagation constant β (rad/cm) of a signal that will resonate with $F_{cav}$ verses $F_{res}$ (GHz). The variation of β is shown for three cases in each of which the cavity length $L_{cav}$ is 5 mm (i.e. β=6.28 rad/cm), the width w of the impedance structures is 2 mm, and the diameter D of boundary structures 16 is 0.8 mm. In curves 50, 52, and 54, the signal frequency F is 30 GHz, 30 GHz, and 34.3 GHz, respectively, while the respective waveguide widths a are 7 mm, 4 mm, and 7 mm. In each case, the waveguide height b is equal to the corresponding width a.

When $F_{res}$ is less than F, β increases and the resonant wavelength decreases ($\beta=2\pi/\lambda_g$). In this case, cavity 26 "lengthens" electrically (i.e. $L_{cav}$ increases) which causes $F_{cav}$ to decrease. When $F_{res}$ is greater than F, β "shrinks" electrically (i.e. $L_{cav}$ decreases) which causes $F_{cav}$ to increase.

At a constant F, β decreases when $F_{res}$ increases, so $F_{res}$ can be chosen so that a desired F resonates with $F_{cav}$. For example, curves 50, 52, and 56 intersect at about $F_{res}$=30 GHz so that β is equal to 6.28 rad/cm (point 51 in the graph). In this case, a signal at F=30 GHz will be transmitted through filter 10. Curve 54 is asymptotic to $L_{cav}=\lambda_g/2$ at higher values of $F_{res}$ indicating that its β value will not fall below 6.28 rad/cm. Since curve 54 does not intersect curve 56, a signal at F=34.3 GHz will not be transmitted through filter 10. Hence, if F is too large, filter 10 will not propagate signals effectively.

FIG. 6 shows that as width a is reduced, the values of F in which $L_{cav}=\lambda_g/2$ increases. For example, curve 50 intersects curve 56 at point 51, but curve 54 with a larger value of width a is asymptotic to curve 56 and does not intersect it. This means that cavity 26 will not resonate with a signal with F=34.3 GHz if a=7 mm. This result can be compared to the curves in FIG. 5 in which width a is equal to 4 mm. Here, curve 60 at 40 GHz intersects curve 56 at point 63 indicating that the upper limit of frequencies capable of being propagated through filter 10 has increased. Thus, width a can be used to control the frequency tuning range of filter 10.

FIG. 7 shows the frequency response in dB of filter 10 for various bias voltages as a function of F (GHz). Shown are the responses at bias voltages of 0 V (curve 71), 1 V (curve 72), and 10 V (curve 73) for filter 10. Curve 70 is the β value in the absence of impedance structures 24 (i.e. sidewalls 11–14 are all conductive). The cavity frequency $F_{cav}$ moved from 31.6 GHz (Point 74) to 33.2 GHz (Point 75) when the reverse bias on capacitors 40 increased from 0 V to 10 V. The center of the pass-band for the waveguide with conductive sidewalls is measured to be about 34.3 GHz (Point 76), which is consistent with the expected value for $L_{cav}$ equal to 5 mm in a waveguide with width a equal to 7 mm.

At 0 V bias, cavity 26 is 'electrically long' and $F_{cav}$ is about 31.6 GHz. As the reverse bias across capacitors 40 increases, $F_{res}$ increases towards 35 GHz. $F_{cav}$, which is slightly higher than $F_{res}$, rises ahead of $F_{res}$ but at a slower rate. $F_{cav}$ will be equal to $F_{res}$ at a frequency in the range between 31.6 GHz to 33.2 GHz. Above this 'coincident frequency', $F_{cav}$ will be lower than $F_{res}$, but it will still increase as $F_{res}$ increases.

FIGS. 8*a*, 8*b*, and 8*c* show top, side, and front elevation views, respectively, of a waveguide filter 100 with an iris structure 25. Filter 100 includes similar numbering to filter 10 with the understanding that the discussion above applies equally well here. Structure 25 includes cavity 26 which is formed from cavity forming boundary structures 41 extending from surfaces 11 and 13 towards the interior of filter 100 so that a distance 44 separates them. Impedance structures 24 are positioned on surfaces 91 between structures 41 and within cavity 26 to adjust the resonant frequency of cavity 26 as discussed above. The operation of filter 100 is similar to the operation of filter 10 in that the capacitance of impedance structure 24 can be adjusted to change $L_{cav}$.

Figure 9:
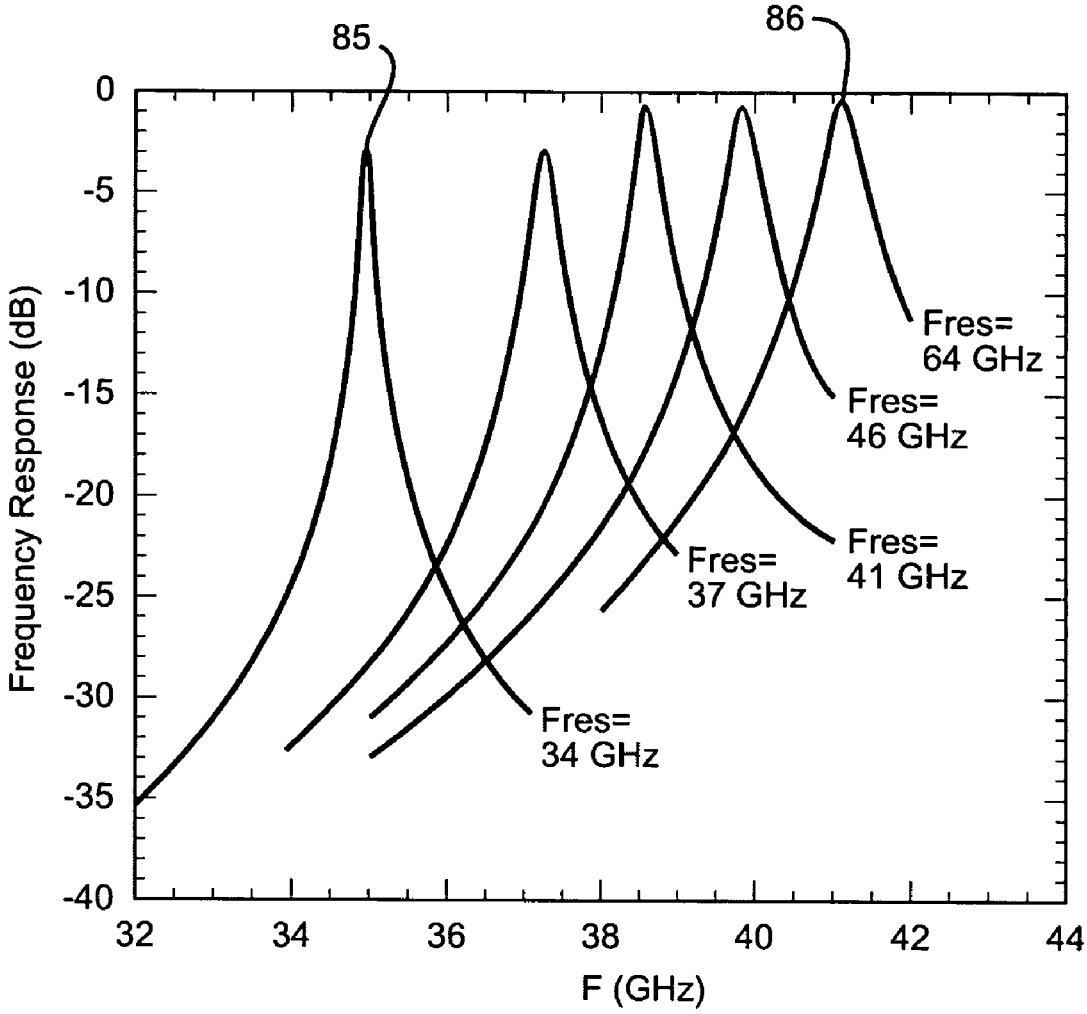
FIG. 9 is a graph of the frequency response of the tunable waveguide filter of FIGS. 8*a*, 8*b*, and 8*c*.

FIG. 9 shows curves of the frequency response of filter 100 when $L_{cav}$ is 5 mm, width a is 2.4 mm, height b is 7 mm, distance 44 is 4 mm, and operating frequency F is varied between 32 GHz and 42 GHz. Without structure 24, i.e. with metal surfaces 91 only, the transmission pass-band peaks at 44 GHz. With impedance structures 24, however, the half-wavelength pass-band moves from about 34.4 GHz (Point 85) to about 41.5 GHz (Point 86). Hence, filter 100 can be tuned like filter 10 to obtain a desired frequency response.

In all of the above embodiments, sidewalls 11-14 can have impedance structures. The waveguide can then be used to filter a vertically and/or a horizontally polarized signal. For vertically polarized signal, impedance structures on sidewalls 12 and 14 filter the signal. For horizontally polarized signals, impedance structures on sidewalls 11 and 13 filter the signal. Only one of sidewalls 11–14 can have an impedance structure to make the bandwidth of the pass-band narrower than the case with two impedance structures positioned on opposed sidwalls. The bandwidth can also be controlled by making the impedance of one impedance structure high while making the impedance of the opposed impedance structure low so that the structure with low impedance behaves like a metallic surface.

In the filters, the cavity forming structures can also include tunable impedance structures so that their impedance can be adjusted to change $L_{cav}$. In filter 10, for example, surfaces of cavity-forming structures 16 can include EMXT structures similar to structures 24 to adjust the impedance of cavity 26. In waveguide 100 surfaces 92, 93, 94, and 95 can include EMXT structures to adjust the impedance of iris structure 25.

Figure 10A:
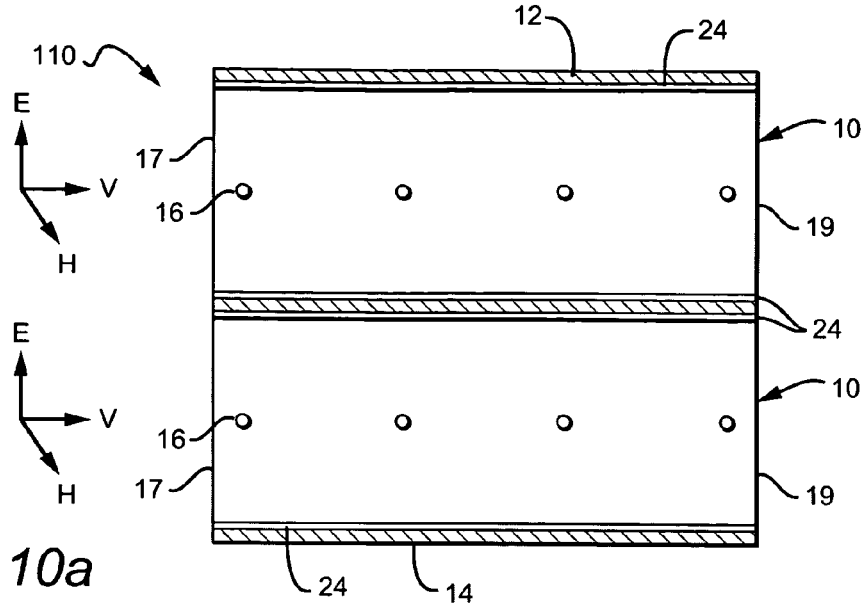
FIGS. 10*a*, 10*b*, and 10*c* are simplified top, side, and front elevation views, respectively, of a notch filter using the tunable waveguide filter of FIG. 3.
Figure 10B:
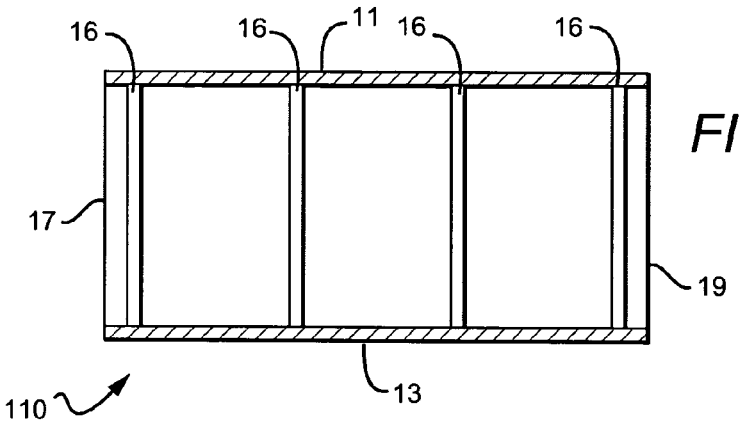
Figure 10C:
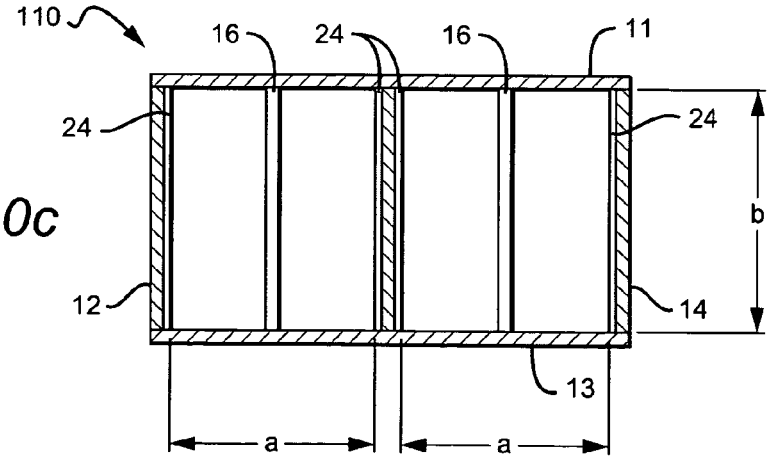

FIG. 10 shows how filter 10 can be used as a notch or band-stop filter. In FIG. 10, a waveguide filter 110 includes two filters 10 positioned side by side. The impedances of structures 24 can be chosen to be different so that the electromagnetic wave flowing through both of them experiences two different β values. When the waves recombine near end 19, they will be out of phase. The phase difference can be used to provide a desired constructive and destructive interference pattern so that certain frequencies are not included in the output signal. In this way, filter 110 behaves as a band-stop or "nulling" filter. Filter 110 can be independently used to rapidly adjust the frequency that is nulled by adjusting the impedance of each structure 24. In one application, this is useful to attenuate an undesired signal from being received by a communication system connected to filter 110. If the undesired signal changes frequency as a function of time, then filter 110 can provide signal tracking by rapidly retuning from one frequency to another.

Hence, a tunable waveguide filter is disclosed. It can be used in systems which typically require multiple filters to provide different resonant frequencies. The filter can provide different resonant frequencies because it can be tuned which decreases the complexity and component count of the communication system. For example, using the waveguide filter, one antenna can provide radar, communications, and other communication functions over many different frequencies.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

We claim:

1. A tunable filter, comprising:

a waveguide with at least one resonant cavity, the inside surfaces of each of said resonant cavities comprising a reactive surface impedance structure which is electronically tunable in a band of frequencies around a common resonant frequency, such that varying said surface impedance varies the propagation constant of a signal transmitted through said resonant cavity and thereby the common resonant frequency of said resonant cavity.

2. The filter of claim 1, wherein said reactive surface impedance structure includes a plurality of electromagnetic crystal structures positioned on at least one sidewall of said waveguide.

3. The filter of claim 1, wherein said reactive surface impedance structure includes variable capacitors with capacitances that can be adjusted to change said surface impedance and thereby said resonant frequency.

4. The filter of claim 3, wherein said variable capacitors are adjustable to establish a passband for said filter.

5. The filter of claim 4, wherein said variable capacitors are adjustable to adjust the bandwidth of said pass-band.

6. The filter of claim 3, wherein said variable capacitors are adjustable to adjust a frequency response of said filter.

7. The filter of claim 1, wherein said reactive surface impedance structures form a series of L-C circuits which resonate in a desired frequency band.

8. The filter of claim 1, wherein said reactive surface impedance structures present a capacitive impedance to frequencies greater than their resonant frequency.

9. The filter of claim 1, wherein said reactive surface impedance structures present an inductive impedance to frequencies less than their resonant frequency.

10. The filter of claim 1, further comprising at least one additional waveguide that cooperates with said waveguide to form a notch filter.

11. The filter of claim 10, wherein said waveguides are independently tunable to adjust a frequency response of said notch filter.

12. The filter of claim 10, wherein said waveguides are independently tunable to transmit and/or reflect desired bands of signal frequencies.

13. The filter of claim 1, wherein said tunable reactive surface impedance structure extends longitudinally down the sidewall of said waveguide.

14. The filter of claim 1, wherein said tunable reactive surface impedance structure includes separate strips of impedance structures positioned in each resonant cavity.

15. A tunable filter, comprising:

one or more resonant cavities, the inside surfaces of each cavity having a reactive surface impedance structure which is electronically tunable in a band of frequencies around respective resonant frequencies, said electronically tunable reactive surface impedance structures being adjustable so as to vary the propagation constants of signals propagating through said cavities so that said filter is adjustable to a desired resonant state and frequency response.

16. The filter of claim 15, wherein said reactive surface impedance structures are capable of tuning a pass-band of said filter.

17. The filter of claim 15, wherein said one or more resonant cavities comprise multiple cavity forming boundary structures.

18. The filter of claim 17, wherein said cavity forming boundary structures include respective inductive posts or iris structures.

19. The filter of claim 15, wherein said reactive surface impedance structures include voltage controlled capacitors which are adjustable to adjust each structure's resonant frequency.

20. The filter of claim 19, wherein each of said reactive surface impedance structures comprise resonant L-C circuits which presents a high impedance at said structure's resonant frequency, and a primarily capacitive impedance at a frequency higher than said resonant frequency.

21. The filter of claim 19, wherein each of said reactive surface impedance structures comprise resonant L-C circuits which present a high impedance which present a high impedance at said structure's resonant frequency, and a primarily inductive impedance at a frequency lower than said resonant frequency.

22. The filter of claim 15, wherein said reactive surface impedance structure includes:

a substrate of dielectric material having two sides;

a conductive layer on one side of said dielectric material;

a plurality of mutually spaced conductive strips on the other side of said dielectric material, said strips being separated by gaps and positioned parallel to said filter's longitudinal axis;

variable capacitance devices across each said gap; and a plurality of conductive vias extending through said dielectric material between said conductive layer and said conductive strips.

23. The filter of claim 22, wherein said variable capacitance devices are adjustable to adjust a resonant frequency of said reactive surface impedance structure.

24. The filter of claim 22, wherein adjacent pairs of said conductive strips, variable capacitance devices, and dielectric substrate present a series of resonant L-C circuits to a signal in resonance with a resonant frequency of said resonant cavities.

25. The filter of claim 22, wherein said conductive strips, variable capacitance devices, and dielectric substrate present a primarily capacitive or inductive impedance to a signal at a frequency higher or lower than a resonant frequency of said reactive surface impedance structure, respectively.

26. The filter of claim 17, further comprising a second tunable impedance structure which is adjustable to adjust an impedance of said multiple cavity forming boundary structures to adjust said a pass-band of said filter.

27. The filter of claim 15, wherein each resonant cavity further comprises a second impedance structure being adjustable to adjust an electrical cavity length of its corresponding resonant cavity to adjust a pass-band of said filter.

28. The filter of claim 15, wherein said resonant cavities are positioned in a waveguide.

* * * * *